US006045286A

United States Patent [19]

Tung

[11] Patent Number: 6,045,286

[45] Date of Patent: Apr. 4, 2000

[54] METAL RING BINDER WITH AUXILIARY SPRINGS

[75] Inventor: Vincent W. M. Tung, Kowloon, The Hong Kong Special Administrative Region of the People's Republic of China

[73] Assignee: Hong Kong Stationery Manufacturing Co., Ltd., Kowloon, The Hong Kong Special Administrative Region of the People's Republic of China

[21] Appl. No.: 09/141,017

[22] Filed: Aug. 27, 1998

[51] Int. Cl.[7] ..... B42F 3/04

[52] U.S. Cl. ..... 402/37; 402/26; 402/31; 402/46

[58] Field of Search ..... 402/26, 31, 36, 402/37, 38, 39, 40, 41, 42, 43, 44, 45, 46

[56] References Cited

U.S. PATENT DOCUMENTS

| | | | |
|---|---|---|---|
| 1,157,184 | 10/1915 | Schade, Jr. . | |
| 2,381,040 | 8/1945 | Dawson et al. . | |
| 4,281,940 | 8/1981 | Rhee | 402/38 |
| 4,552,478 | 11/1985 | Cohen . | |
| 5,158,386 | 10/1992 | Mann, Jr. | 402/41 |
| 5,393,156 | 2/1995 | Mullin et al. | 402/36 |
| 5,692,847 | 12/1997 | Zane et al. | 402/38 |
| 5,782,569 | 7/1998 | Mullin et al. | 402/36 |
| 5,788,392 | 8/1998 | Cheung | 402/26 |

*Primary Examiner*—Andrea L. Pitts
*Assistant Examiner*—Monica Smith
*Attorney, Agent, or Firm*—Shoemaker and Mattare, Ltd

[57] ABSTRACT

A metal ring binder is improved by adding at least one auxiliary spring for supplementing the spring action of the spine upon the blades to which the rings are attached, so as to increase the closing force of the rings.

5 Claims, 3 Drawing Sheets

METAL RING BINDER WITH AUXILIARY SPRINGS

BACKGROUND OF THE INVENTION

This invention relates to a metal ring binder having auxiliary springs. Like many ring binder mechanisms, intended for notebooks, the binder described below comprises three rings, each made in two halves. The lower end of each spring half is swaged or otherwise connected to one of two blades which are held in compression, edge-to-edge, within a curved sheet metal spine. The blades are stable at two positions: one, where the rings are closed, and another, where the rings are fully open. The compression force exerted on the blades by the spine cause a toggling action—so that the blades are unstable at intermediate positions—and the mechanism proceeds to either extreme position with a familiar snap when one applies enough opening or closing force to the rings. A lever mechanism is usually installed at one or both ends of the spine, to assist one in opening the rings, or in locking them closed.

In most ring binders, the spine provides the only spring force for the rings, flattening somewhat as the blades pass their intermediate (coplanar) position. It can be shown that the bending stress is distributed throughout the length of the spine, but that greater bending stress occurs near the rings. The designer must therefore select metal for the spine having sufficient yield strength, modulus, and thickness in the vicinity of the rings, to provide adequate spring action and to survive repeated opening and closing. As a consequence, when using sheet metal of uniform thickness, the spine may be substantially thicker than necessary away from the rings. Additionally, the designer may have to compromise his choice of spine material to provide the needed clamping force on the edges of the blades. In some ways, therefore, it would be better to supplement the spring action with elements other than the spine metal.

SUMMARY OF THE INVENTION

An object of the invention is to improve the spring force of a ring binder without increasing the thickness of the spine metal, or, conversely, to enable a designer to reduce the thickness of the spine metal without sacrificing closing force.

A related object is to enable one to select metal for a ring binder spine based on considerations other than strength. A further object is to reduce the cost of materials for making a ring binder.

These and other objects are attained by providing a ring binder mechanism with auxiliary springs, one in the vicinity of each ring, to supplement each ring's closing force. Details of a preferred embodiment of the invention appear in the drawings, and are described below.

BRIEF DESCRIPTION OF THE DRAWINGS

In the accompanying drawings.

DESCRIPTION OF THE PREFERRED EMBODIMENT

Figure 1:
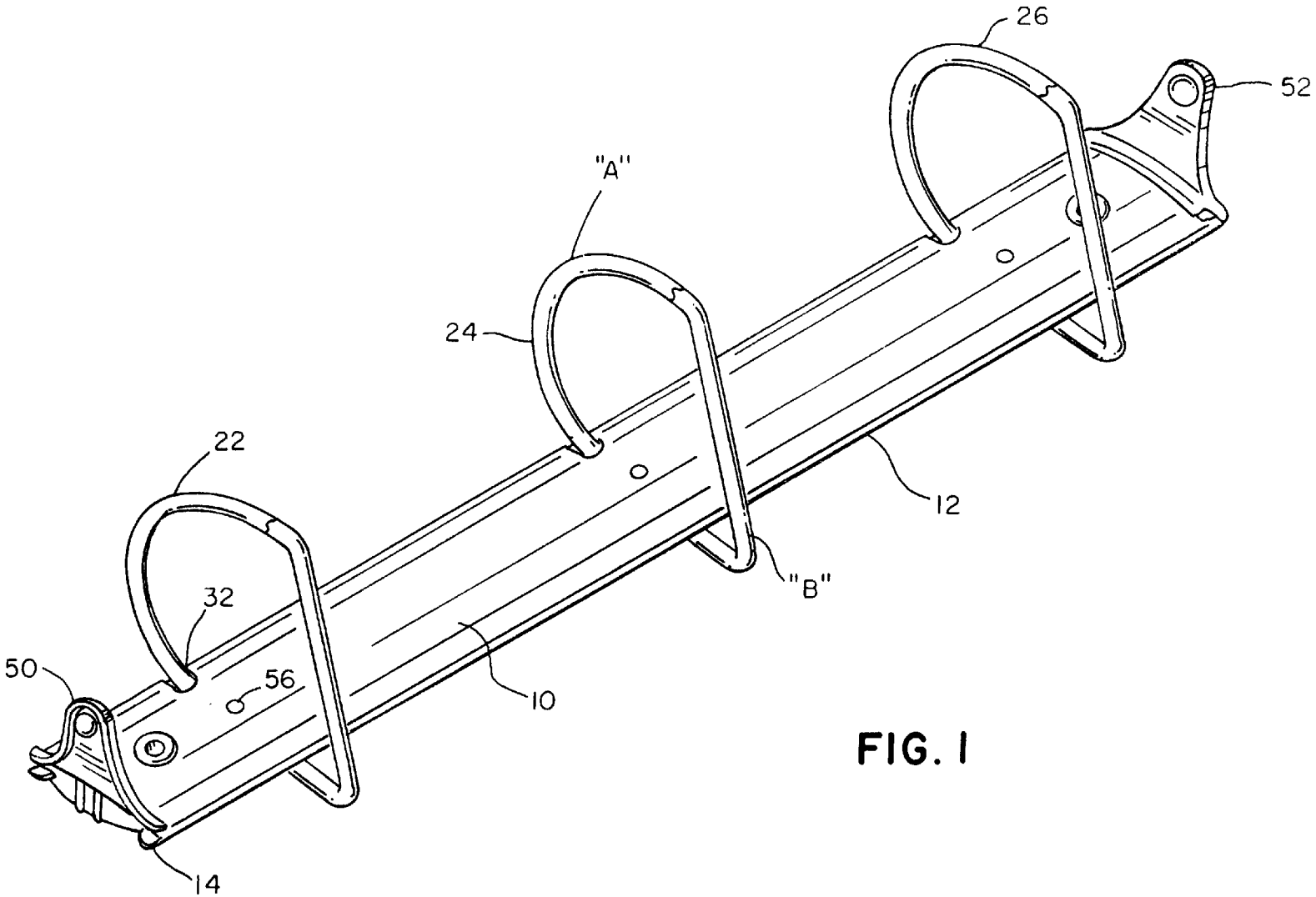
FIG. 1 is a perspective view of a metal ring binder with spring leaves embodying the invention, with the rings closed.
Figure 2:
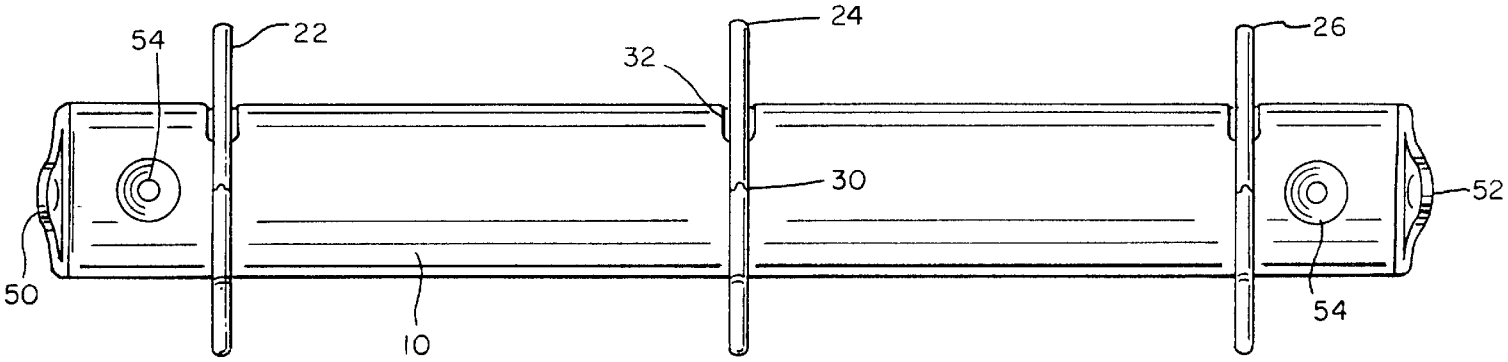
FIG. 2 is a top plan view of the binder.

A metal ring binder embodying the invention comprises a sheet metal spine 10 having a generally convex upper surface. The lateral edges 12 of the spine are bent inward toward one another along bend lines 14 so as to define seats which support the outer edges of a pair of flat sheet metal blades 16, 18 whose inner edges are held in alignment by alternating swaged tabs 20 20. Three rings 22, 24, 26, each formed in two halves, are supported by the blades, one end 28 of each ring half being rigidly affixed to a respective blade, as by welding or swaging. The tips 30 of the ring halves have sinusoidal serrations which mesh when the rings are closed to maintain alignment of the tips.

The rings illustrated are asymmetrical, one half "A" being semicircular and protruding through a hole 32 in the spine, the other "B" having a straight segment and extending around the corresponding edge of the spine, rather than going through it. The straight-segment design provides somewhat greater paper capacity.

The device as described so far is conventional. What is new is the auxiliary leaf springs 34, 36, 38 appearing in FIG. 3. The leaf springs shown are downwardly convex, that is, their curvature is opposite that of the spine. Each of the auxiliary springs is closely adjacent a respective ring, being set off to the side just enough to avoid physical interference between the spring and the bottom of the straight-segment ring half. Of course, if both ring halves were like the semicircular half "A" shown, it would be possible to place each spring right on the plane of its respective ring.

Each spring is made of spring metal. Its ends 42 are passed through slots 44 in the blades, and are bent inward so as to be retained in the slots, while providing a compressing force drawing the blades together. Each of the presently preferred auxiliary springs has a length slightly less that the width of the spine, and a width less than its length.

Figure 3:
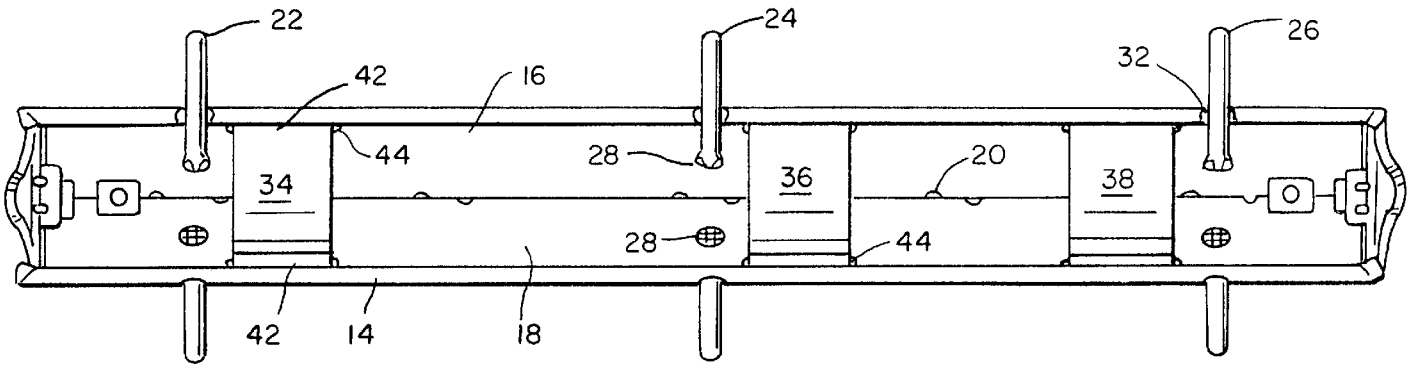
FIG. 3 is a bottom plan view thereof.
Figure 4:
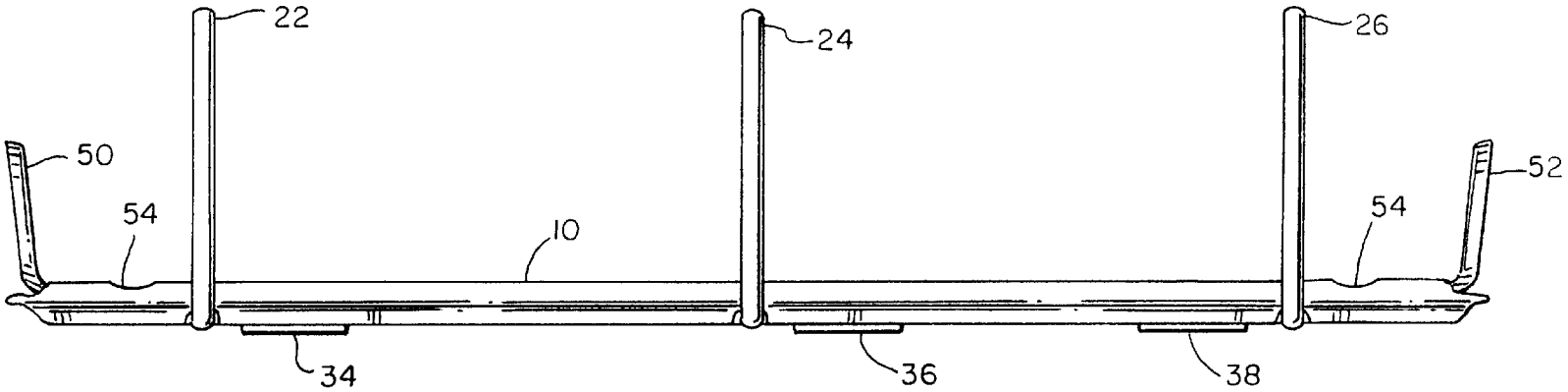
FIG. 4 is a side elevation thereof, the opposite side being identical.
Figure 6:
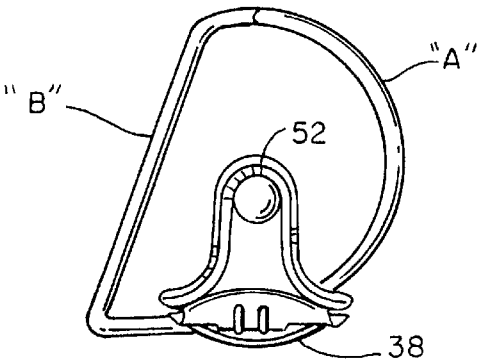
FIG. 6 is an elevational view of the right end of the binder.
Figure 5:
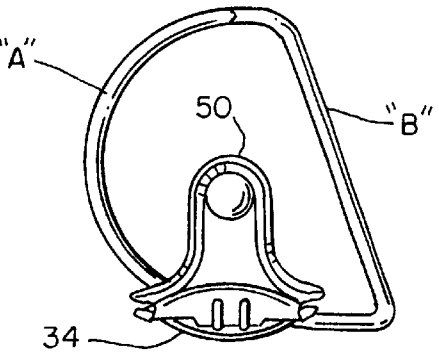
FIG. 5 is a elevational view of the left end of the binder.

The auxiliary springs need not be identical, even though identical springs are shown in FIG. 3. It may be that the spring strength or other characteristics could be advantageously varied to improve the opening or closing action of the binder.

One should appreciate that the springs and blades could be connected in a number of other ways: for example, the slots could be eliminated and the leaf springs lengthened slightly so as to pass around the edges of the blades, perhaps being clamped between the blade edges and the seats of the spine. Also, other types of springs might be used, for example, coil springs, torsion springs or other alternatives.

Actuating levers 50, 52 are illustrated in the drawings, but these are not described in detail as they do not affect the inventive features described above. Suffice it to say that one can open the rings by pressing the levers outward, away from one another, in a manner well known in this field. The holes 54 at the ends of the binder are for rivets used to secure the binder in a notebook. The dimples 56 adjacent the holes 32 limit the upward (opening) movement of the blades. The downward movement is of course limited by the engagement of the tips with one another.

Since the invention is subject to modifications and variations, it is intended that the foregoing description and the accompanying drawings shall be interpreted as only illustrative of the invention defined by the following claims.

I claim:

1. In a ring binder comprising a metal spine having lateral edges, a pair of blades held in edgewise compression between the lateral edges of the spine whereby the spine provides a spring action affecting hinging movement of the blades, at least two rings formed in two halves, each ring half having a lower end affixed to one of the blades and a tip adapted to engage the tip of an opposite counterpart ring half when the rings are closed, the improvement comprising at least one auxiliary leaf spring for supplementing the spring action of the spine upon the blades so as to increase the closing/opening force of the rings, wherein the spine is upwardly convex and each of said leaf springs is downwardly convex.

2. The invention of claim 1, wherein one of said auxiliary springs is provided for each of said rings.

3. The invention of claim 2, wherein each of said leaf springs is adjacent a respective ring so as to concentrate its action on that ring.

4. The invention of claim 1, wherein each of said blades has a plurality of slots adapted to receive an end of one of the leaf springs, and the ends of respective leaf spring is deformed so as to be retained within the slot while holding the blades in edgewise compression.

5. In a ring binder comprising a metal spine having lateral edges, a pair of blades held in edgewise compression between the lateral edges of the spine whereby the spine provides a spring action affecting hinging movement of the blades, at least two rings formed in two halves, each ring half having a lower end affixed to one of the blades and a tip adapted to engage the tip of an opposite counterpart ring half when the rings are closed, the improvement comprising at least one auxiliary leaf spring for supplementing the spring action of the spine upon the blades so as to increase the closing/opening force of the rings, wherein each of said leaf springs has a length slightly less that the width of the spine, and a width less than its length.

* * * * *